US010245496B1

(12) United States Patent
Palmer

(10) Patent No.: US 10,245,496 B1
(45) Date of Patent: Apr. 2, 2019

(54) PIVOTING POLE VAULT CROSS BAR PIN

(71) Applicant: Christopher L. Palmer, Needmore, PA (US)

(72) Inventor: Christopher L. Palmer, Needmore, PA (US)

( * ) Notice: Subject to any disclaimer, the term of this patent is extended or adjusted under 35 U.S.C. 154(b) by 0 days.

(21) Appl. No.: 15/726,424

(22) Filed: Oct. 6, 2017

(51) Int. Cl.
*A63B 5/02* (2006.01)
*A63B 71/02* (2006.01)

(52) U.S. Cl.
CPC ..... *A63B 71/023* (2013.01); *A63B 5/02* (2013.01)

(58) Field of Classification Search
CPC ..... A63B 71/02; A63B 2071/02; A63B 5/00
See application file for complete search history.

(56) References Cited

U.S. PATENT DOCUMENTS 2,898,797 A 8/1959 Bronstein
3,222,064 A 12/1965 Langton
3,644,023 A * 2/1972 Villani ..... G02C 5/2227 351/113
3,815,902 A * 6/1974 Tomlinson ..... A63B 5/02 482/16
3,900,180 A 8/1975 McPhee
3,957,241 A 5/1976 Morris et al.
4,089,553 A * 5/1978 Frykholm ..... B25J 1/04 294/104
4,604,803 A 8/1986 Sawby
5,005,828 A 4/1991 Sauerbrey
6,393,664 B1 5/2002 Habegger et al.
6,502,844 B1 1/2003 Winland
6,899,644 B1 5/2005 Song et al.
7,896,786 B1 * 3/2011 Osbourne ..... A63B 21/0552 482/122
9,301,658 B1 4/2016 Boeltl
2004/0077418 A1 * 4/2004 Shulla ..... A63B 5/02 472/88
2006/0071136 A1 4/2006 Livingstone et al.
2008/0086924 A1 4/2008 Kicher et al.
2009/0255360 A1 10/2009 Witteveen et al.
2010/0190612 A1 * 7/2010 Cook ..... A63B 71/023 482/38
2011/0092338 A1 * 4/2011 Bentley ..... A63B 5/06 482/18
2011/0155035 A1 6/2011 Czipri
2011/0155040 A1 6/2011 Czipri
2013/0000077 A1 1/2013 Thompson
2016/0303414 A1 * 10/2016 Werner ..... A63B 5/16

* cited by examiner

*Primary Examiner* — Garrett K Atkinson
(74) *Attorney, Agent, or Firm* — Hanrahan Law Firm, P.A.; Benjamin M. Hanrahan

(57) ABSTRACT

A pivoting or collapsible pole vault cross bar pin is disclosed herein. Specifically, the pin includes a base that is mountable to the pole vault standard or upright stanchion, and a support arm. The support arm is spring-biased and disposable between an operative, extended position and a collapsed, pivoted position. When in the extended position, the support arm or pin assembly is structured to support a cross bar thereon, such as a cross bar used in a pole vaulting track and field event. Upon sufficient impact, the support arm will collapse or pivot in a downward direction, thereby releasing the cross bar and minimizing potential injury to an athlete, either by avoiding a violent impact with the cross bar or the pin assembly, itself.

19 Claims, 10 Drawing Sheets

PIVOTING POLE VAULT CROSS BAR PIN

FIELD OF THE INVENTION

The present invention is generally directed to a pin assembly that is mounted to a pole vault standard and which supports the cross bar used in pole vaulting events. Specifically, the pin includes a pivoting assembly that allows the pin to collapse or pivot downward when an amount of force is applied thereto.

BACKGROUND OF THE INVENTION

Pole vaulting is a track and field event in which an athlete uses an elongated and generally flexible pole as an aid to hoist the athlete up and over a cross bar without knocking the cross bar down. The cross bar is supported on or by two uprights or stanchions, often referred to as standards, on opposite sides. In particular, a standard can include a plurality of pins or supports that extend outward from the standard and which are used to support the cross bar, for example, at different heights.

It should be noted that the length of the pin(s), or otherwise the length the pins extend out from the standard, may vary depending on, for example, the particular event or level. For example, collegiate level track and field events, or more specifically collegiate pole vaulting events, may require the pin to have an extension length of 55 millimeters, whereas high school or other pole vaulting events may require the pin to have an extension length of 75 millimeters.

Unfortunately, in some cases, the cross bar and/or the pins or supports that are used to maintain the cross bar in the supported or horizontal position can be dangerous or can cause injuries to the athlete, particularly in the event of a failed attempt to clear the cross bar. For example, in one situation, the athlete may impact the cross bar, for instance anywhere along the length of the cross bar, during an attempt, which often results in a failed attempt to clear the cross bar. However, with the cross bar supported by the pins or other supports connected to or integrated as part of the standards, impacting the cross bar in the air, for example, by falling down onto the cross bar, can create a dangerous and violent situation. Specifically, if the cross bar does not immediately fall or become dislodged from the pins or other supports from the standards, impacting the cross bar during a failed attempt can cause injuries, sometimes rather severe injuries, to the athlete.

In another situation, during an attempt to clear the cross bar, the athlete may inadvertently impact one or more of the pins or other supports that hold or retain the cross bar. As the pins or supports are often rigid and fixed to the standard, when an athlete impacts the pin(s) or support(s) in the air, for example, when falling from a failed (or sometimes even successful) attempt to clear the cross bar, the pin(s) or support(s) can cause severe injuries to the athlete.

Accordingly, there is a need in the art for an improved or novel pin assembly that can support the cross bar in a pole vaulting event, while also being configured to eliminate or minimize potential injury in the event an athlete impacts the pin(s) or the cross bar during an attempt. Specifically, it would be advantageous if the proposed pin assembly could support the cross bar in a resting or horizontal position, while also being capable of collapsing in the event of an impact, either directly on the pin assembly itself, or upon the cross bar. The proposed pin assembly would advantageously be constructed to meet the length requirements of the particular event, if any, as well as other potential standards, requirements or specifications, including, but not limited to impact or force requirements.

SUMMARY OF THE INVENTION

Accordingly, the present invention is generally directed to a pin assembly that can be mounted to a standard or upright and which can be used to support the cross bar in a pole vaulting event. In addition, the pin assembly can be safely pivoted between an operative, extended position—for supporting the cross bar—and collapsed position. For instance, when the pin assembly is extended, the cross bar can be supported thereon in a generally horizontal manner, ready for an athlete to attempt to clear the bar. In addition, the pin assembly can be pivoted or collapsed, for example, in a downward direction. When the pin assembly is collapsed, the cross bar may no longer be able to be supported thereon, and the outward extension of the pin assembly from the standard is significantly reduced. Accordingly, the probability that an athlete will be engaged in a violent impact with the cross bar and/or pin assembly, itself, during attempt is eliminated or at a minimum drastically reduced.

For example, the pin assembly of at least one embodiment includes a spring-loaded mechanism that it integral to or disposed at least substantially within the pin. The spring-loaded mechanism keeps the pin in a normal, generally horizontal position until a force is applied to the pin that is greater than the force exerted by the spring-loaded mechanism.

Specifically, a spring-loaded ball or like device may be normally engaged at least partially within or by a concave detent via a coiled spring or other like biasing device. A force exerted upon the top surface of the pin, for example, via a falling athlete, can cause the pin to break away or collapse by disengaging the spring-loaded ball from the detent. In some cases, the pivot point or hinge may be located proximate to (for example, within 0.5 inches) the standard, and thus, the force required to collapse the pin is greater near the cross bar or standard than it is at the outer distal end of the pin. Accordingly, in the event an athlete contacts the end of the pin, the force required to collapse the pin is quite low (e.g., in the range of 3 pounds), and the risk of injury is thereby significantly reduced or even eliminated.

It should also be noted that once the pin is collapsed, for example, either intentionally or via a falling athlete, the pin can be easily readjusted or repositioned back into the operative, extended position. Specifically, simply rotating or pivoting the support arm portion of the pin back up will serve to reengage the biased ball within the detent. Thus, the pin assembly can be reused even after it has been collapsed by simply resetting the pin back into the extended position.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

As shown in the accompanying drawings, and with particular reference to FIGS. 1 through 4, the present invention is directed to a pin assembly, generally referenced as 10, that is mountable to a pole vault standard 1 for supporting a cross bar 5, for example, for use in the track and field event known as pole vaulting. In particular, the pin assembly 10 of the various embodiments disclosed herein is configured to collapse downward, for example, in a pivoting, rotating or hinged fashion, when an amount of force is applied to top of the pin assembly 10. This can be caused by a falling vaulter or athlete impacting the cross bar 5, a falling vaulter or athlete impacting the pin assembly 10 itself, etc. The ability for the pin assembly 10 of the present invention to collapse or pivot downward can be considered a safety feature in that it can avoid or minimize violent impacts between the athlete and the pin directly, or between the athlete and the cross bar 5.

Figure 1:
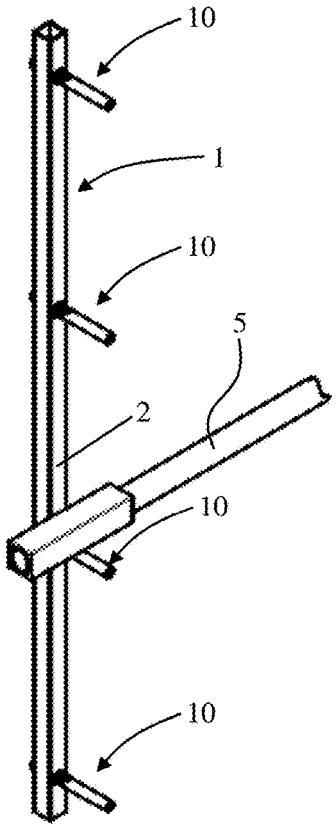
FIG. 1 is a perspective view of the pin assembly mounted to a standard and at least partially supporting a cross bar as disclosed in accordance with at least one embodiment of the present invention.
Figure 2:
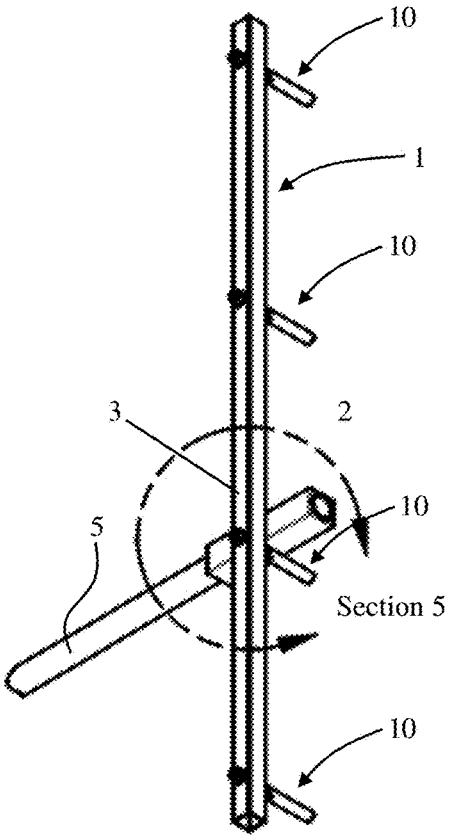
FIG. 2 is another perspective view of the pin assembly illustrated in FIG. 1.
Figure 3:
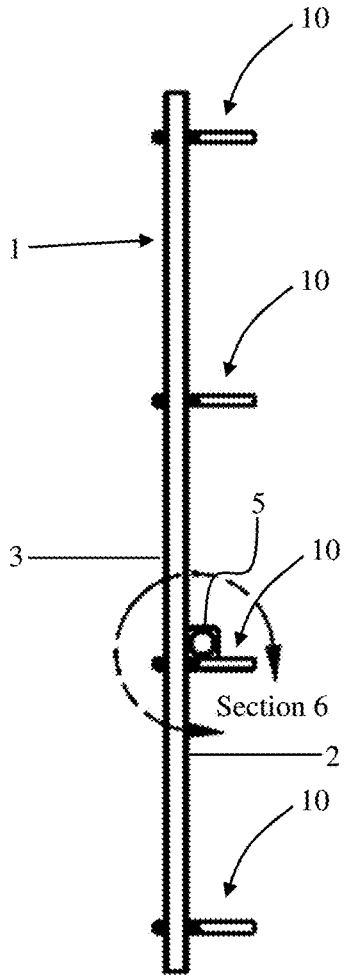
FIG. 3 is a side view of the pin assembly illustrated in FIG. 1.
Figure 4:
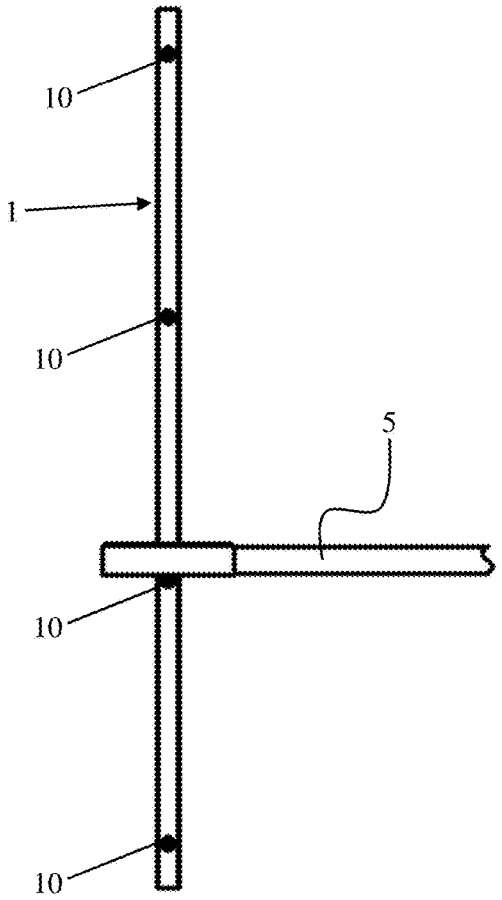
FIG. 4 is a front view of the pin assembly as illustrated in FIG. 1.
Figure 5:
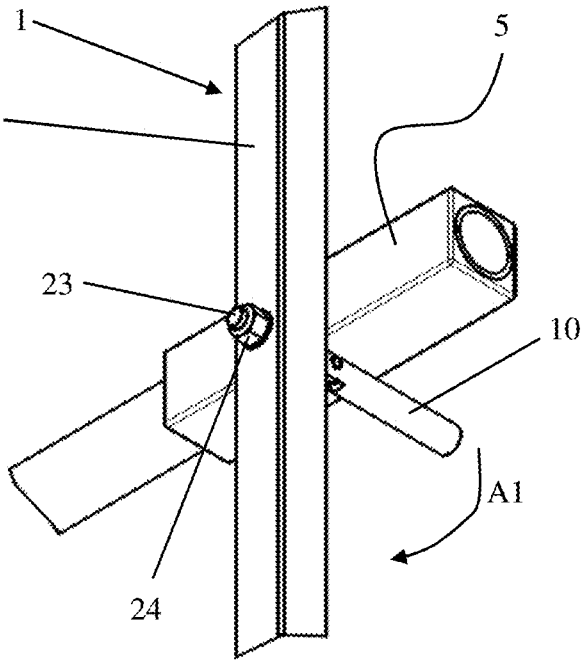
FIG. 5 is a sectional view within Section 5 illustrated in FIG. 2.
Figure 6:
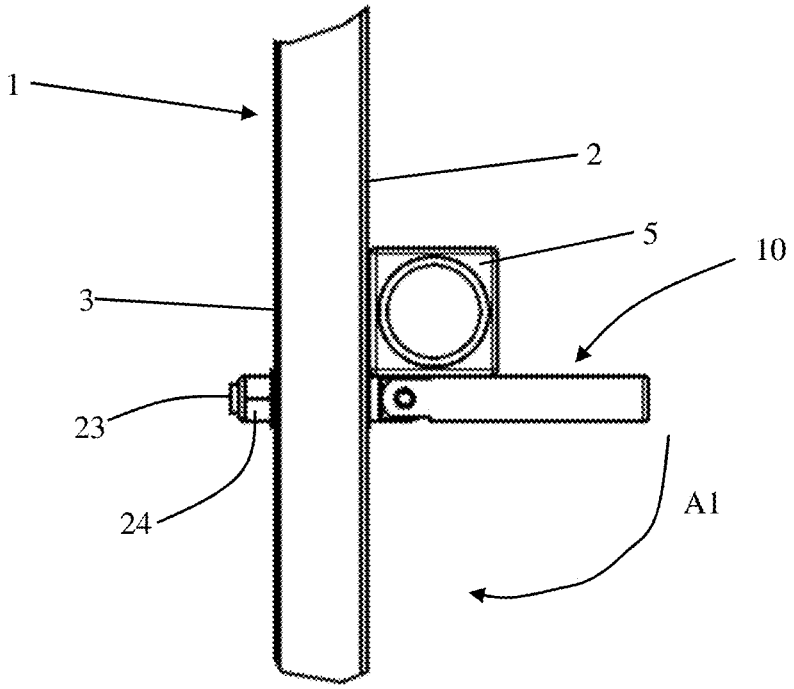
FIG. 6 is a section view within Section 6 illustrated in FIG. 3.

For example, FIGS. 5 and 6 illustrate partial cut-away or sectional views of section 5 and 6 shown in FIGS. 2 and 3, respectively. Particularly, in FIGS. 5 and 6, the pin assembly 10 of at least one embodiment is shown as being mounted to the standard 1, with the cross bar supported upon a top surface of the pin assembly 10. This is the normal starting or resting position of the cross bar 5 and pin assembly 10. In the event of a force exerted upon the cross bar 5 or pin assembly 10, for example, a downward force exerted upon the top surface of the pin assembly 10, the pin assembly 10 will collapse into an at least partially downward position, for example, in a pivoting or hinged manner, as represented by arrow A1. This will serve to minimize or eliminate violent impacts between the athlete and the pin assembly 10 and/or between the athlete and the cross bar 5.

Referring now to FIGS. 7A through 7F, at least one embodiment of the pin assembly 10 of the present invention is illustrated. Particularly, the pin assembly 10 of at least one embodiment includes two members or pieces—a base 20 and an elongated pivoting support arm 30. The base 20 and the support arm 30 may be interconnected to one another via a pivot joint 12, which in some embodiments includes a pin or dowel disposed through corresponding holes or channels in both the base 20 and the support arm 30. Other joints configured to implement the present invention in the intended manner are contemplated.

Figure 7A:
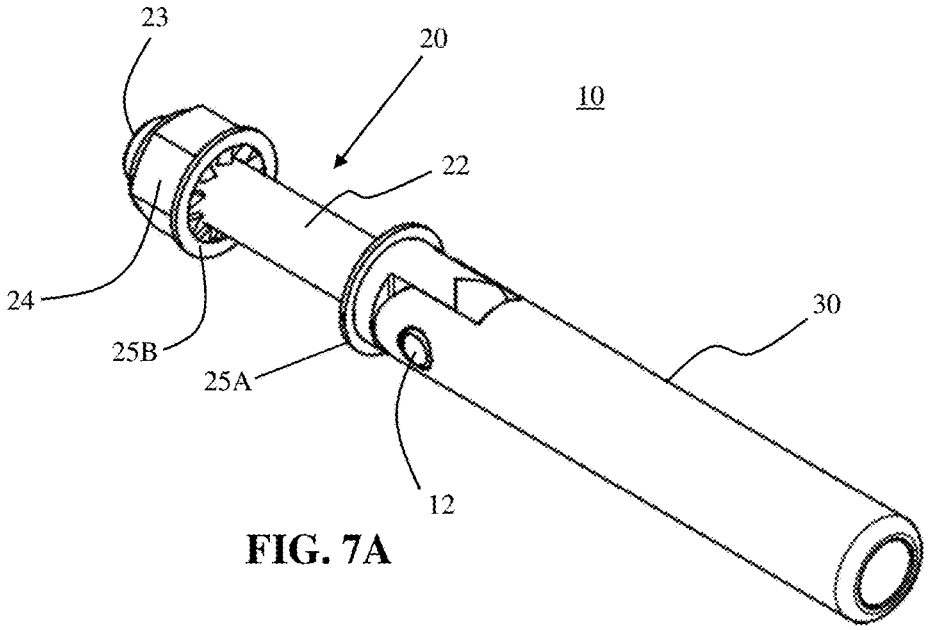
FIG. 7A is a perspective view of the pin assembly as disclosed in accordance with at least one embodiment of the present invention.
Figure 7B:
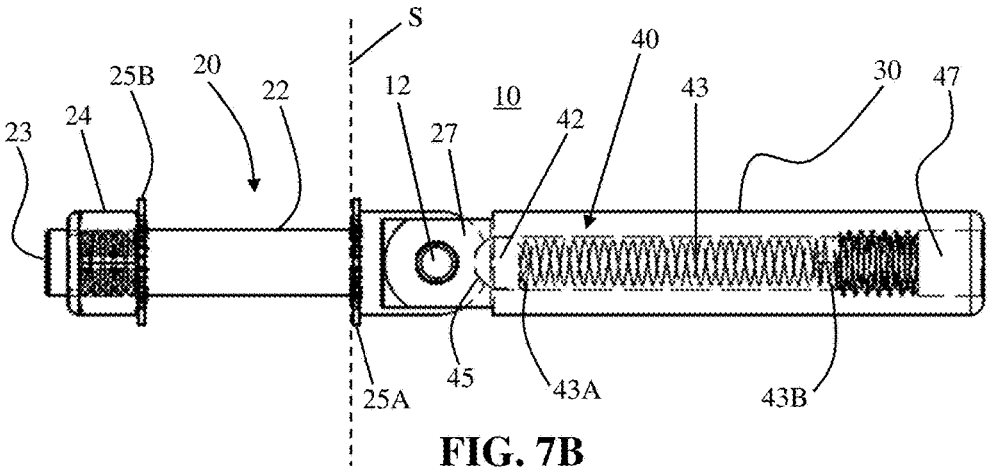
FIG. 7B is a partially transparent side elevation view of the pin assembly illustrated in FIG. 7A, showing the internal components thereof.
Figure 7C:
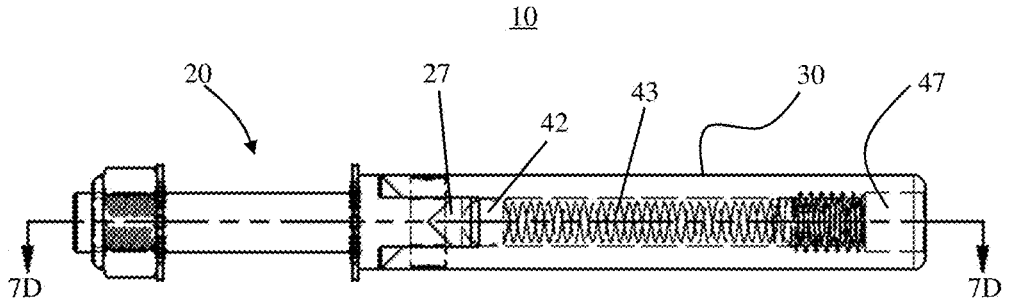
FIG. 7C is a partially transparent top view of the pin assembly illustrated in FIG. 7A, showing the internal components thereof.
Figure 7D:
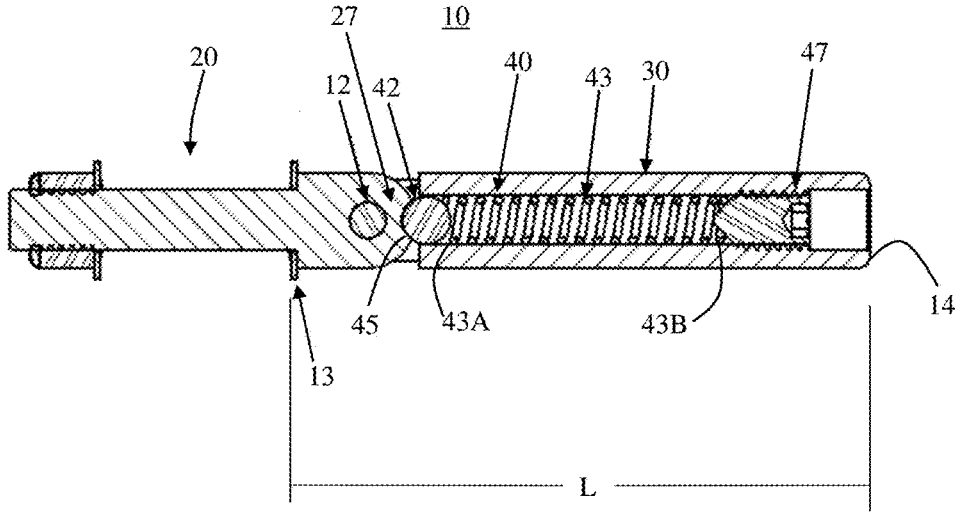
FIG. 7D is a cut-away or sectional view along line 7D-7D illustrated in FIG. 7C.
Figure 7E:
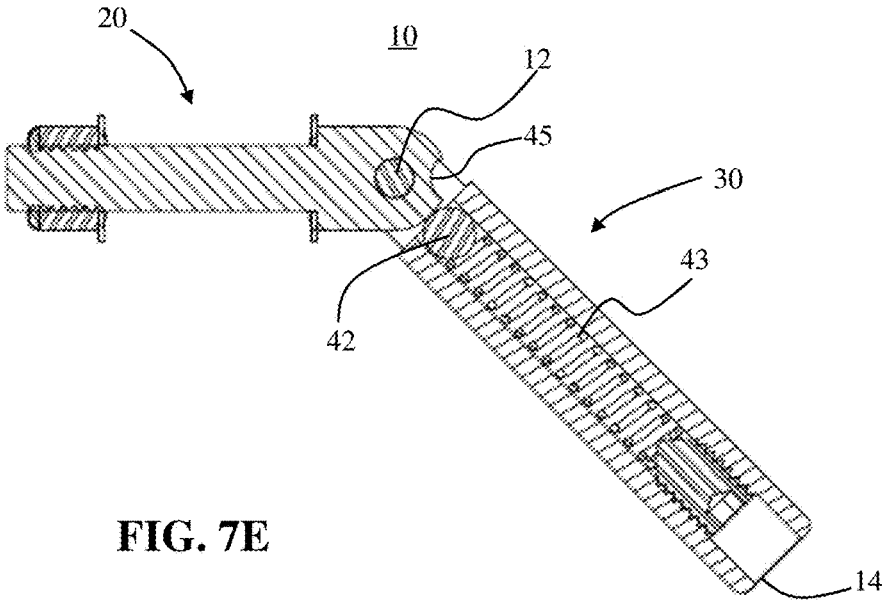
FIG. 7E is a cut-away or sectional view of the pin assembly in a partially collapsed position with the biased ball disengaged from the detent.
Figure 7F:
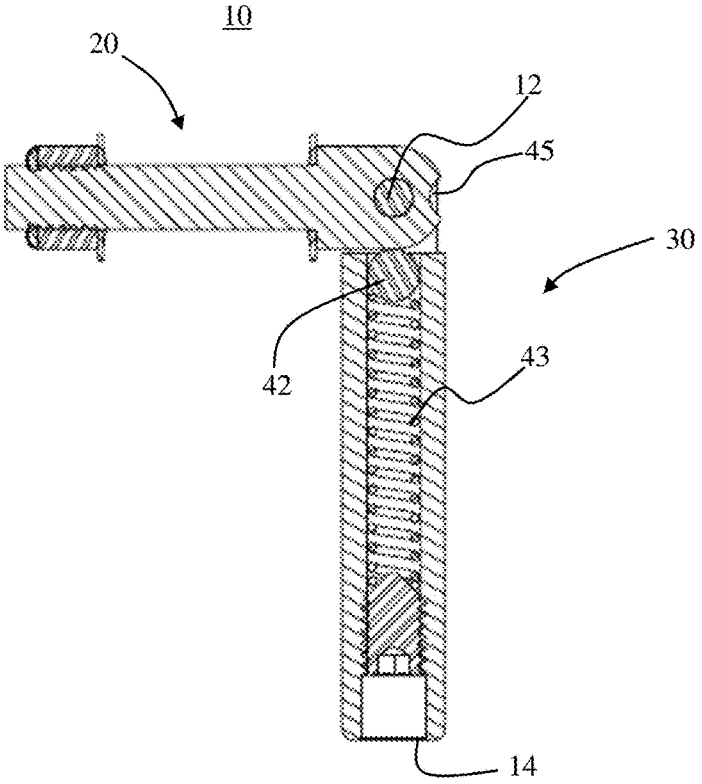
FIG. 7F is another cut-away or sectional view of the pin assembly disposed in a collapsed position.
Figure 8A:
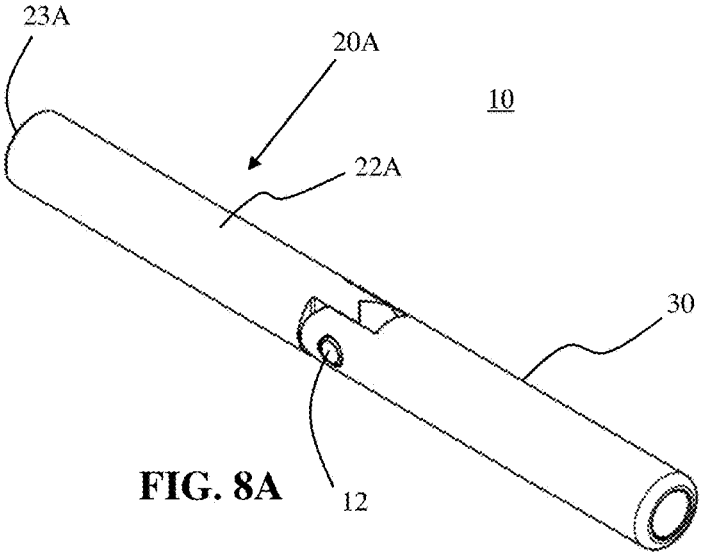
FIG. 8A is a perspective view of the pin assembly as disclosed in accordance with another embodiment of the present invention.
Figure 8B:
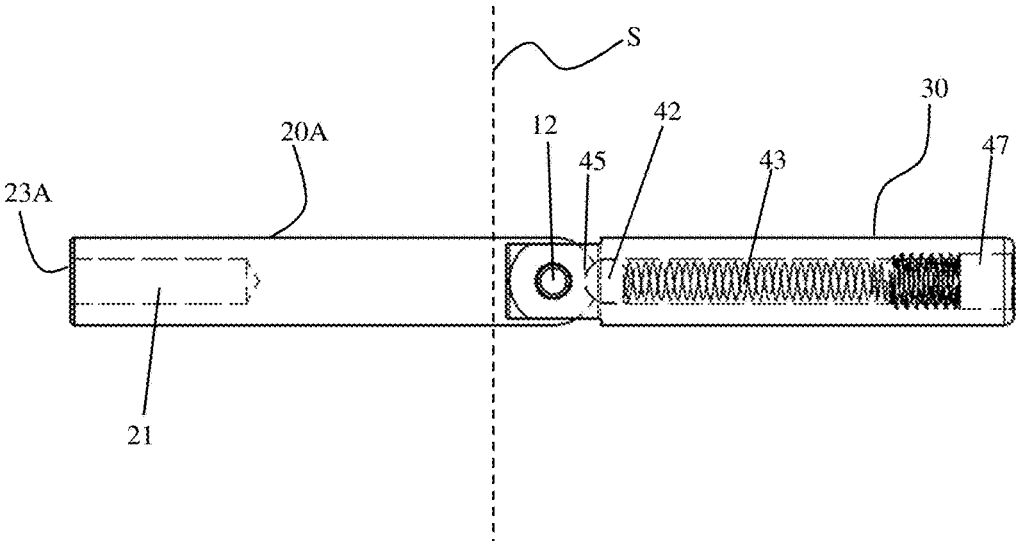
FIG. 8B is a partially transparent side elevation view of the pin assembly illustrated in FIG. 8A, showing the internal components thereof.
Figure 8C:
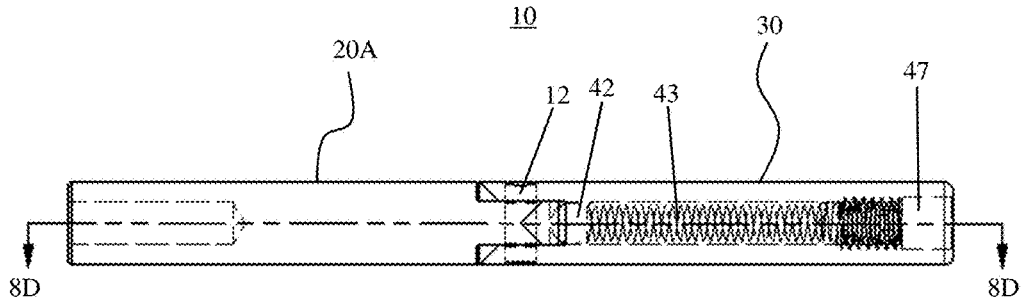
FIG. 8C is a partially transparent top view of the pin assembly illustrated in FIG. 8A, showing the internal components thereof.
Figure 8D:
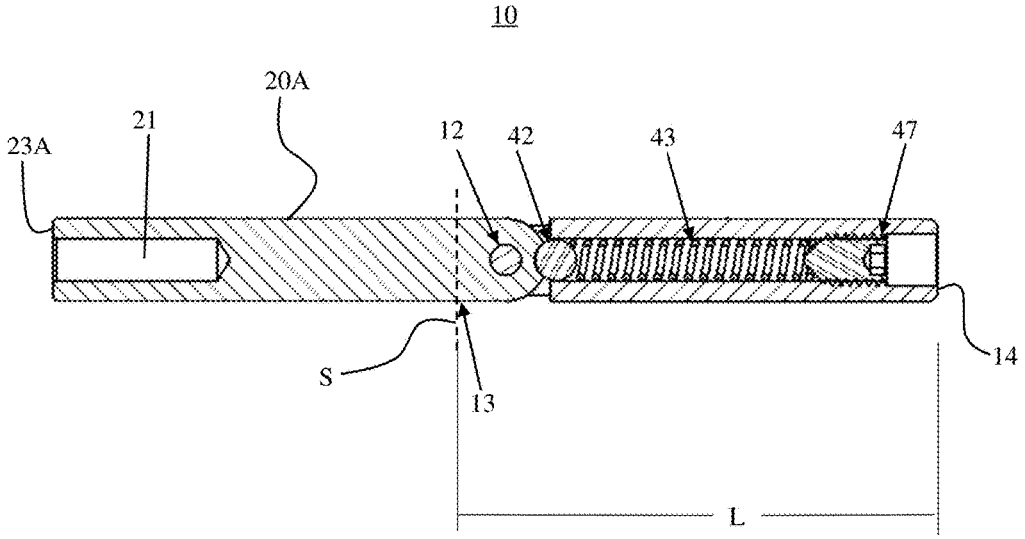
FIG. 8D is a cut-away or sectional view along line 8D-8D illustrated in FIG. 8C.

Furthermore, the base 20 is mountable or otherwise connected or fixedly attached to the pole vault standard 1, while the support arm 30 is pivotally disposable between an extended position (FIGS. 7A through 7D) and a collapsed position (FIGS. 7E and 7F). For instance, still referring to the embodiment illustrated in FIGS. 7A through 7D, the base 20 includes a neck portion 22 that is inserted into a corresponding hole or channel in the standard 1 (as shown in FIGS. 1 through 6). In addition, a threaded lock nut 24 or other locking member is then secured to a distal end 23 of the base 20 (e.g., as shown in FIGS. 5 and 6), to secure the base 20 to the standard 1. One or more washers 25A/B or like devices can also be secured or disposed against a first or facing surface 2 of the standard 1 and/or between the lock nut 24 and a second or rear surface 3 of the standard 1.

FIGS. 8A through 8D illustrate yet another base 20A that mounts to the standard in a different manner than the base 20 illustrated in FIGS. 7A through 7D. For example, in this embodiment, the base 20A includes a substantially uniform cylindrical neck 22A that can be disposed within or through a corresponding channel (not shown) of the standard 1. A locking bolt, screw or other like mechanism can then be secured or threaded into the outer or distal end 23A. For example, in the embodiment illustrated in FIGS. 8A through 8D, the distal end 23A of the base 20A includes a locking channel 21 within which a locking bolt, screw, etc. can be secured or inserted in order to mount or fixedly secure the base 20A to the pole vault standard 1.

It should be noted that other embodiments of the pin assembly 10 of the present invention may include other or different mounting mechanisms or different configurations of the base 20, 20A in order to facilitate a secure connection to the pole vault standard 1. In any event, the base 20, 20A of the present invention is mounted or mountable to the standard 1, which can be accomplished in a variety of different manners which are within the full spirit and scope of the present invention. For instance, the different mounting mechanisms or the specific configuration of the base 20, 20A may depend on the particular standard 1 upon which the pin assembly 10 is to be mounted.

In any event, with reference to FIGS. 7A through 8D, the pin assembly 10 of the various embodiments of the present invention includes a support arm 30 upon which the cross bar 5 is disposed, or otherwise upon which the cross bar 5 can rest. The support arm 30, according to the various embodiments herein, is disposable between an extended position (e.g., FIGS. 7A and 8A) and a pivoted or collapsed position.

In some embodiments, the extended position can be defined as the support arm being disposed in a generally horizontal manner, for example, when the pin assembly 10 is mounted to the standard 1. Specifically, with the base 20 mounted to the standard 10, the support arm 30 may extend laterally or horizontally outward, for example, from a corresponding or facing surface 2 of the standard 1. The facing surface 2 can be referred to as the surface of the standard 1 from which the pin assembly 10, and in particular the support arm 30 thereof, extends in order to support the cross bar 5. Since the standard 1 can be constructed in a number of different manners and can therefore have different shapes and configurations, the extended position of the support arm 30 of at least one embodiment can be defined as being generally horizontal to the ground or otherwise in a position capable of supporting the cross bar 5 in a horizontal or level position.

In some embodiments, and in particular, the embodiments illustrated in FIGS. 7A through 7D, and FIGS. 8A through 8D, the extended position of the support arm 30 can be referred to as the support arm 30 being disposed in a generally axially aligned relation with the base 20, 20A. In such an embodiment, the base 20, 20A and the support arm 30 may be axially aligned or otherwise share a longitudinal axis when the support arm 30 is extended.

However, again, since the base 20, 20A of the various embodiments may have different shapes and configurations, when the support arm 30 is disposed in the extended position, it may not be axially aligned with the base.

Furthermore, as provided herein, the pin assembly 10, and in particular the support arm 30 thereof, is disposable into a collapsed position, such as, when a sufficient amount of force is exerted upon the support arm 30. The collapsed position can be defined as the support arm 30 being pivoted about a pivot joint 12 in a manner such that the support arm 30 is angled when compared to its extended position. For instance, when the pin assembly 10 is mounted to a pole vault standard 1, the collapsed position is defined as the support arm 30 being pivoted at least partially downward, for instance, when a downward force is exerted on a top surface of the support arm 30. In some embodiments, the support arm 30 may pivot approximately ninety degrees (90°) downward, although it is contemplated that the support arms 30 can pivot more or less than 90° within the scope of the various embodiments herein. In any event, when the support arm 30 is collapsed or otherwise pivoted in a generally downward direction, the cross bar 5 will cease to be supported thereon and will fall downward.

Moreover, the pin assembly 10 of the various embodiments of the present invention includes a pivoting assembly, generally referenced as 40, which is structured to maintain the support arm 30 in the extended position, at least until a sufficient counter force or downward force is exerted upon the support arm 30. For instance, in at least one embodiment, the pivoting assembly 40 includes a spring biased ball or other device 42 that is normally engaged within a corresponding detent 45, at least while the support arm 30 is disposed in the extended position.

Specifically, the pivoting assembly 40 of at least one embodiment include a biasing device 43 which is configured to normally or push against a biased device 42. When the support arm 30 is extended, the biased device 42 is pushed into or otherwise biased against or into an at least partially engaging relation with a corresponding detent 45, thereby locking the support arm 30 in place, at least until a sufficient amount of force is exerted thereupon. As provided in the Figures, and with particular reference to FIGS. 7B through 7F, for example, the biasing device 43 of at least one embodiment includes a coiled spring, although other biasing devices structured to exert a biasing force upon the biased device 42 in order to implement the present invention in the intended manner is within the full spirit and scope of the disclosure presented herein. In addition, the biased device 42 of at least one embodiment may include a biased ball or other rounded, circular or spherical element. However, other biased devices structured and configured to implement the present invention in the intended manner is contemplated herein.

Still referring to FIGS. 7B through 7F, the detent 45 of at least one embodiment may include a concave configuration disposed on an end, such as a proximal end 27 of the base 20. The detent 45 is configured to at least partially engage or at least partially receive a portion of the biased ball 42, for instance, when the support arm 30 is extended. In this manner, the spring 43 or other biasing device of at least one embodiment, is therefore disposed within the support arm 30, such as, within a corresponding internal channel extending at least partially along the length of the support arm 30. For instance, the spring 43 or other biasing device includes a proximal end 43A and an opposite distal end 43B, the proximate end 43A being disposed in a biased engaging relation with the biased ball 42, thereby pushing or biasing the ball 42 at least partially into the detent 45 when the support arm 30 is extended.

The opposite distal end 43B of the spring 43 or other biasing device of at least one embodiment may be disposed in an engaged relation with a bias adjustment device 47. For instance, the bias adjustment device 47 may be selectively moved in a longitudinal manner, for instance, against the spring 43. Adjustment or movement of the bias adjustment device 47 of at least one embodiment, for example, inward or toward the spring 43 can serve to compress the spring 43 further, thereby strengthening the biasing strength of spring 43 against the ball 42. Similarly, movement of the biasing adjustment device 47 outward, for example, away from the spring 43, can serve to at least partially release or lessen the biasing strength of the spring 43, thereby lessening or weakening the biasing strength of the spring 43 against the ball 42.

In some embodiments, the bias adjustment device 47 includes a threaded screw or other device which can be selectively twisted or screwed toward or away from the spring 43 in order to adjust the biasing strength of the spring 43 against the biased ball 42, as described herein. However, other adjustment devices can be implemented within the spirit and scope of the present invention.

Figure 9:
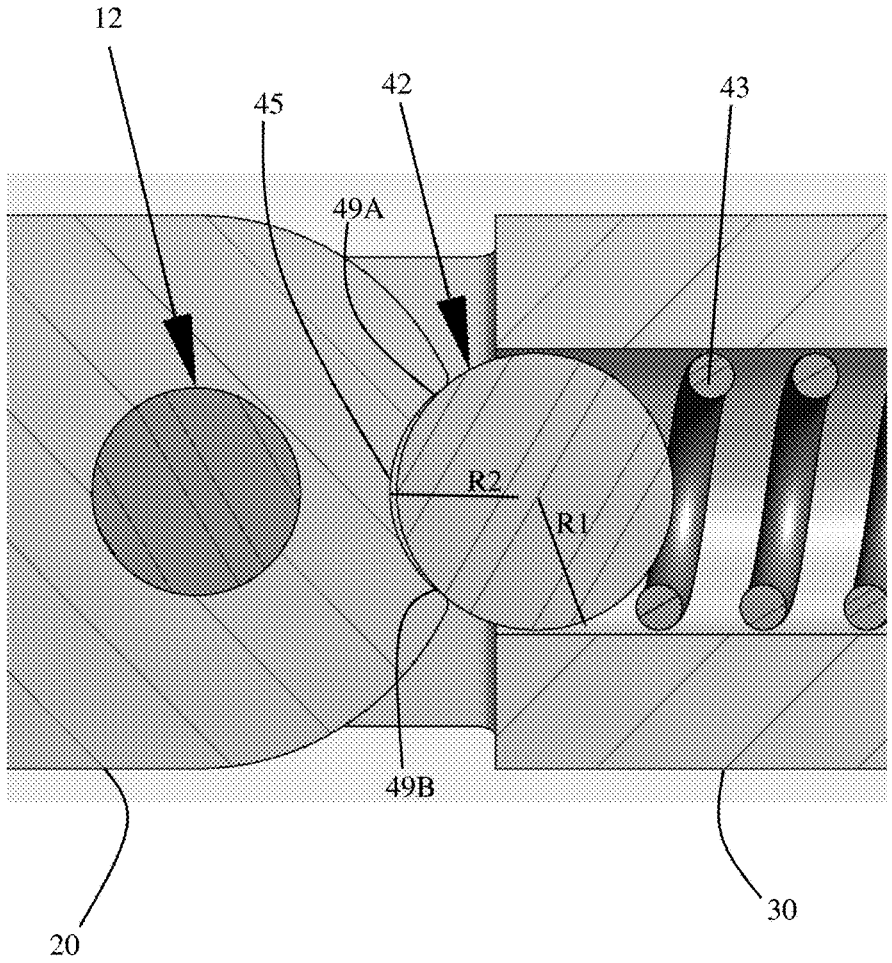
FIG. 9 is a close-up sectional view of the biased ball and detent as disclosed in accordance with at least one embodiment of the present invention.

Referring now to the partial cut-away or sectional view of FIG. 9, the cooperative engagement between the detent 45 and the biased ball 42 of at least one embodiment is illustrated. For example, the ball or other biased device 42 and the detent 45 may engage with or otherwise contact one another at two separate contain points, represented as 49A and 49B, and in some case, the biased device 42 or ball and the detent 45 will only contact one another at these two contact points 49A, 49B. In order to accomplish this, the curvature or concave configuration of the detent 45 may include a radius R2 that is different than or less than the radius R1 of the ball 42. In this manner, the ball 42 of at least one embodiment is larger than the detent 45 in that the curved surface of the ball 42 or other biased device will not exactly or precisely mate with the curved surface of the detent 45. This creates an engagement between the biased ball 42 and the detent 45 that can be dislodged via a lesser amount of force than would be required if the ball 42 and the detent 45 had the same radii.

It should be noted, however, that other embodiments or implementations may include a biased ball 42 or other biased device that has the same or substantially the same radius as the detent 45. In such a case, the force required to dislodge the biased ball 42 from the detent 45 may be greater or the radii can be smaller or adjusted in a way to achieve the same or similar results.

With reference to FIGS. 7E and 7F, the pin assembly 10 of at least one embodiment is illustrated as being collapsed or at least partially collapsed in that the biased ball 42 is disengaged or dislodged from the detent 45. In such a manner, the support arm 30 may pivot, for example, downward, while the ball 42 moves along a portion of the outside or other surface of the base 20, as illustrated. In some embodiments, the support art 30 may be structured to pivot ninety degrees (90°) downward, as compared to the extended position or, in some cases, as compared to the axial positioning of the base 20, as illustrated in FIG. 7F. However, in other embodiments, as contemplated herein, the support arm 30 can pivot more or less than ninety degrees.

Furthermore, once the pin assembly 10, and in particular, the support arm 30 thereof, is collapsed, for example, either intentionally or via a falling athlete, the support arm 30 can be easily repositioned back into the operative, extended position ready for another use or otherwise ready to again support a cross bar 5. Specifically, a user may simply manually rotate or pivot the support arm 30 back up in order to reengage pivoting assembly 40, and in particular, in order to reengage the biased ball 42 with the detent 45. Thus, the pin assembly 10 of at least one embodiment can be reused even after it has been collapsed by simply resetting the support arm 30 back into the extended position.

It should also be noted that the length, width and other dimensions of the pin assembly, including the length/width of the base 20 and the length/width of the support arm 30, may vary, depending on, for example, the particular situation, application, event or the athletes involved. Specifically, different track and field events, tournaments, or situations may require or call for a pin having a particular or different extension length L. The extension length L can be defined as the length or distance the pin assembly 10 extends out from the standard 1, and can thus be measured from the facing surface 2 of the standard 1 (or from a first exposed point or location 13 of the pin assembly 10 that extends or will extend from the standard 1) to the outer distal end 14 of the pin assembly 10. Accordingly, in the embodiments illustrated, the extension length L of the pin assembly may be slightly different than or slightly greater than the length of the support arm 30 in that the base 20 of some embodiments may extend slightly from the standard 1 and thus the length of the base 20 may slightly contribute to the extension length L of the pin assembly 10.

In any event, the exposed or extension length L of the pin assembly 10 of the various embodiments can be different, again, depending on the particular event or situation. As an example, collegiate track and field events, or more specifically collegiate pole vaulting events, may require the pin to have an extension length L of 55 millimeters long, whereas high school track and field or pole vaulting events may require the pin to have an extension length L of 75 millimeters. Of course, other lengths and dimensions of the pin assembly 10, including the extension length L, the length of the base 20 and/or the length of the support arm 30 are contemplated within the full spirit and scope of the present invention, and thus, the dimension provided herein should not be deemed limiting in any manner.

Figure 10:
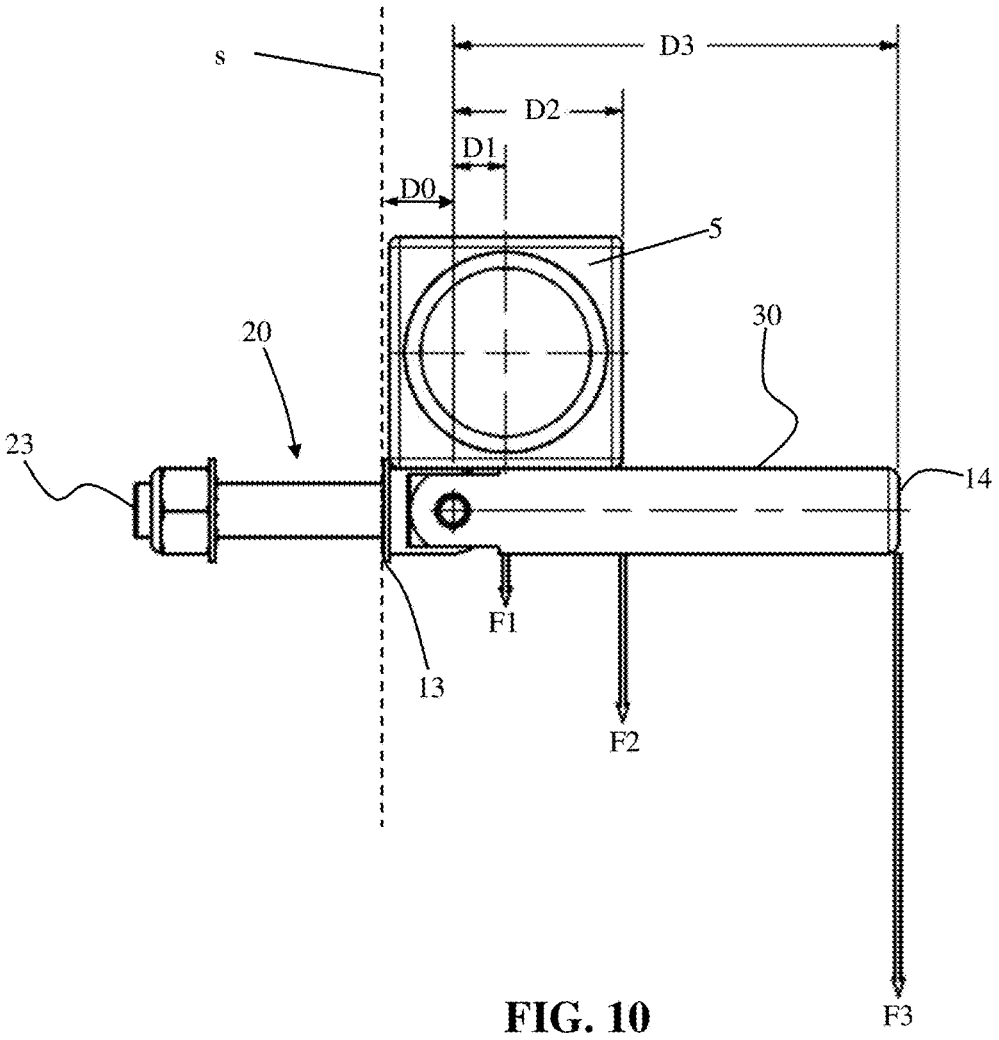
FIG. 10 is a schematic representation illustrating different downward forces applied to the top surface of the pin assembly.

Referring now to FIG. 10, a schematic drawing representing the different forces required to dislodge the biased ball 42 from the detent 45, and therefore dispose the support arm 30 from the extended to the collapsed position, is shown. For instance, dashed line S (also shown in FIGS. 7B and 8B) is shown to represent the relative location of the standard 1, and in particular, the first or facing surface 2 of the standard 1 of at least one embodiment of the present invention. It should be noted that joint 12, which is the pivot joint upon which the support arm 30 pivots or moves between the extended and collapsed position, may be located relatively close and proximate to the facing surface 2 (represented by line S) of the standard 1. In particular, as illustrated in FIG. 10, the joint 12 of at least one embodiment disposed a distance D1 from the standard 1 or otherwise a distance D1 from the facing surface 2 of the standard 1. In some cases, the distance D1 may be in the range of 0.5 inches or less, and in some embodiments, approximately 0.3 to 0.4 inches. With the cross bar 5 in place and abutting or substantially abutting the facing surface 2 of the standard 1, the pivoting joint 12 may be between the center C of the cross bar and the standard 1. In this manner, when the support arm 30 pivots downward into the collapsed position, the cross bar 5 will fall or otherwise will cease to be supported by the pin assembly 10 or support arm 30 thereof.

It should also be noted that the force required to dislodge the pivoting assembly or otherwise cause the support arm 30 to pivot into the collapsed position of at least one embodiment is different depending upon where along the length of the support arm 30 the force is applied, and in particular, the distance from pivot joint 12. For instance, still referring to FIG. 10, three separate locations or distances D1, D2, D3 from the pivot joint are illustrated showing that the forces F1, F2, F3 required to pivot the support arm 30 downward and into the collapsed position is different depending on where the force is applied. Specifically, as the distance from the pivot joint 12 increases, the force required to pivot the support arm 30 decreases, and thus, F3 is less than F2, which is less than F1.

Assuming, for exemplary purposes only, that the extension length L of the pin assembly 10 illustrated in FIG. 10 is approximately equal to 75 millimeters or approximately 3 inches, if D1 is approximately 0.31 inches or about 7.9 millimeters, then, in one example, the force F1 required to pivot support arm 30 into the collapsed position may be about 25.4 pounds of force. If the distance D2 is approximately equal to 1 inch or 25.4 millimeters, then the force F2 required to pivot the support arm 30 into the collapsed position may be about 7.9 pounds of force. If distance D3 is approximately equal to 2.62 inches or 66.5 millimeters, then the force F3 at the outer distal end 14 of the pin assembly required to pivot the support arm 30 into the collapsed position may be about 3.0 pounds of force. Of course, other specifications and forces may be implemented with the full spirit and scope of the various embodiments of the present invention, and thus, the specifications provided herein should be considered exemplary in nature and not deemed limiting.

In this regard, however, it should be noted that the force required to collapse the support arm is much greater toward the standard 1 or otherwise proximate the cross bar 5 than it is at the outer distal end 14. This allows the pin 10 to collapse or pivot downward easily when contacted, for example, by a falling athlete, at the distal end 14 thereof.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

Now that the invention has been described,

What is claimed is:

1. A pole vault cross bar pin, said pin being mountable to a pole vault standard and configured to at least temporarily support a portion of a cross bar, said pin comprising:

a base, said base being mountable to the pole vault standard, a support arm, said support arm being disposable between an extended position and a collapsed position, said extended position being defined as said support arm being extended laterally outward from a facing surface of the standard when said pin is mounted to the standard, and said collapsed position being defined as said support arm being disposed in an at least partially downwardly pivoted direction when said pin is mounted to the standard, a pivoting assembly structured to maintain said support arm in said extended position at least until a downward force is exerted upon said support arm sufficient to allow said support arm to pivot downward into said collapsed position via said pivoting assembly, and said pivoting assembly comprising a biasing device disposed in an engaging relation with a biased device, wherein said biased device is biased at least partially into an engaging relation with a detent when said support arm is disposed in said extended position, and wherein said biased device is released from said detent when said support arm is disposed into said collapsed position.

2. The pin as recited in claim 1 wherein said base comprises a joint upon which said support arm pivots, said joint being disposed proximate to the facing surface of the standard when said pin is mounted to the standard.

3. The pin as recited in claim 2 wherein said joint is disposed a distance less than 0.5 inches from the facing surface of the standard when said pin is mounted to the standard.

4. The pin as recited in claim 1 wherein said detent is disposed on an end of said base and structured to at least partially engage said biased device when said support arm is disposed in said extended position.

5. The pin as recited in claim 4 wherein said biased device comprises a ball disposed in an at least partially engaged relation with said detent when said support arm is disposed in said extended position.

6. The pin as recited in claim 5 wherein said ball and said detent contact one another at two separate contact points when said support arm is disposed in said extended position.

7. The pin as recited in claim 6 wherein said detent comprises a curvature with a radius smaller than a radius of said ball.

8. The pin as recited in claim 7 wherein said ball and said detent only contact at said two separate contact points when said support arm is disposed in said extended position.

9. The pin as recited in claim 5 wherein said biasing device comprises a spring disposed within an internal channel of said support arm, said spring comprising a proximal end and a distal end, said proximal end of said spring being disposed in a biasing engaged relation with said ball.

10. The pin as recited in claim 9 further comprising a bias adjustment device disposed at said distal end of said spring, said bias adjustment device being configured to allow selective adjustment of said spring.

11. The pin as recited in claim 10 wherein said bias adjustment device comprises a screw selectively adjustable in an engaged relation against said distal end of said spring.

12. A pole vault cross bar pin, said pin being mountable to a pole vault standard and configured to at least temporarily support a portion of a cross bar, said pin comprising:

a base, said base being mountable to the pole vault standard, a support arm, said support arm being pivotally disposable between an extended position and a collapsed position via a pivoting assembly, said extended position being defined as said support arm being disposed in an axially aligned relation with said base, and said collapsed position being defined as said support arm being disposed in an at least partially downwardly angled relation relative to said base, said pivoting assembly comprising a biasing spring disposed within an internal channel of said support arm, a biased ball disposed at a proximal end of said spring, and a detent disposed on an end of said base, said biased ball being at least partially engaged with said detent via said spring when said support arm is disposed in said extended position, and said positioning assembly being structured to maintain said support arm in said extended position at least until a downward force is exerted upon said support arm sufficient to dislodge said biased ball from said detent and pivot said support arm downward into said collapsed position.

13. The pin as recited in claim 1 wherein said base comprises a pivoting joint upon which said support arm pivots between said extended position and said collapsed position, said joint being disposed proximate a facing surface of the standard when said pin is mounted to the standard.

14. The pin as recited in claim 13 wherein said pivoting joint is disposed a distance less than 0.5 inches from the facing surface of the standard when said pin is mounted to the standard.

15. The pin as recited in claim 14 wherein said biased ball and said detent contact one another at two separate contact points when said support arm is disposed in said extended position.

16. The pin as recited in claim 15 wherein said detent comprises a curvature with a radius smaller than a radius of said biased ball.

17. The pin as recited in claim 16 wherein said biased ball and said detent only contact at said two separate contact points when said support arm is disposed in said extended position.

18. The pin as recited in claim 16 further comprising a bias adjustment device disposed at said distal end of said biasing spring, said bias adjustment device being configured to allow selective adjustment of said biasing spring.

19. The pin as recited in claim 18 wherein said bias adjustment device comprises a screw selectively adjustable in an engaged relation against said distal end of said biasing spring.

* * * * *